US007959485B2

(12) United States Patent
Kessler

(10) Patent No.: US 7,959,485 B2
(45) Date of Patent: Jun. 14, 2011

(54) EXERCISE AND PLAY HOOP

(75) Inventor: Brian D. Kessler, Los Angeles, CA (US)

(73) Assignee: Maui Toys, Inc., Los Angeles, CA (US)

( * ) Notice: Subject to any disclaimer, the term of this patent is extended or adjusted under 35 U.S.C. 154(b) by 0 days.

(21) Appl. No.: 12/492,742

(22) Filed: Jun. 26, 2009

(65) Prior Publication Data

US 2009/0258567 A1 Oct. 15, 2009

Related U.S. Application Data

(63) Continuation of application No. 11/408,063, filed on Apr. 21, 2006, now Pat. No. 7,566,255.

(60) Provisional application No. 60/673,817, filed on Apr. 22, 2005.

(51) Int. Cl.
*A63H 1/16* (2006.01)
*A63H 33/00* (2006.01)

(52) U.S. Cl. ..... 446/236; 446/26

(58) Field of Classification Search ..... 446/26, 446/236, 237; 482/110; 63/15, 15.2, 3, 3.1
See application file for complete search history.

(56) References Cited

U.S. PATENT DOCUMENTS

| | | | | |
|---|---|---|---|---|
| 1,855,331 | A | 4/1932 | Bernier | |
| 3,326,551 | A | 6/1967 | Clarke | |
| 5,491,017 | A * | 2/1996 | Todt | 428/198 |
| 5,538,454 | A | 7/1996 | Kessler | |
| 5,823,846 | A | 10/1998 | Arriola | |
| 6,062,045 | A | 5/2000 | West | |
| 6,494,760 | B1 | 12/2002 | Kessler | |
| 6,966,814 | B2 | 11/2005 | Mendel | |
| 2005/0070202 | A1 | 3/2005 | Mendel | |

FOREIGN PATENT DOCUMENTS

| | | | |
|---|---|---|---|
| DE | 92 17 219 | U1 | 3/1993 |
| DE | 202 06 819 | U1 | 10/2002 |
| FR | 2 285 913 | A | 4/1976 |
| FR | 2 428 453 | A | 1/1980 |
| GB | 845 066 | A | 8/1960 |
| JP | 2003033445 | A | 2/2003 |
| WO | WO9412242 | | 6/1994 |

* cited by examiner

*Primary Examiner* — Kien T Nguyen
(74) *Attorney, Agent, or Firm* — Browdy and Neimark, PLLC

(57) ABSTRACT

A play and/or exercise hoop for hip gyration is formed of a tube formed into a circle, the tube having a cross-section with a flat outwardly facing wall suitable for accepting a decorative strip adhered thereto. The cross-sectional shape of the tube is D-shaped.

6 Claims, 3 Drawing Sheets

EXERCISE AND PLAY HOOP

The present application is a continuation of co-pending U.S. application Ser. No. 11/408,063 filed Apr. 21, 2006 and claims benefit of U.S. Provisional Appln. No. 60/673,817.

FIELD OF INVENTION

The present invention relates to play and/or exercise hoops of the type commonly known as "HULA HOOPS".

DESCRIPTION OF THE PRIOR ART

Play hoops for rotation about the body are widely known, and used for rolling and gyrating about the hips and other parts of the body. These hoops are typically made from a length of plastic tubing having a circular cross-section. The plastic tubing is bent into the length of a circle and the ends are joined to form the hoop. Decoration is commonly provided by covering or wrapping the curved cylindrical surface, e.g. see Kessler U.S. Pat. No. 5,538,454; Kessler U.S. Pat. No. 6,482,136 and Kessler U.S. Pat. No. 6,494,760.

Such hoops may take other forms as well, noting Roh et al U.S. Pat. No. 6,431,939, and be internally weighted (Kessler '136 and '760, and Roh '939), but such hoops are still formed of tubes having a circular cross-section, i.e. an annular profile in cross-section through the tubing.

Aesthetically, it would be desirable to provide other types of decoration, but the cylindrical nature of the tubing makes this difficult at best, and in certain ways impossible.

SUMMARY OF INVENTION

The present invention is directed to a play and/or exercise hoop of the general type discussed above, and is characterized by a tube cross-section which is preferably substantially D-shaped, with the flat surface of the "D" facing outwardly. The flat outwardly facing surface is preferably bounded by two end ribs. Simplified decorations of various types can be easily applied to the flat surface simply in the form of a decorative tape that is applied to the flat surface between the two end ribs.

By "flat surface", what is meant is a surface which is flat in cross-section through the tubing, even though curved about the hoop. Such surface is also "flat" in the D-shaped tubing before the ends are joined in a circle to form the hoop.

DETAILED DESCRIPTION OF DRAWING

DETAILED DESCRIPTION OF EMBODIMENTS

Figure 1:
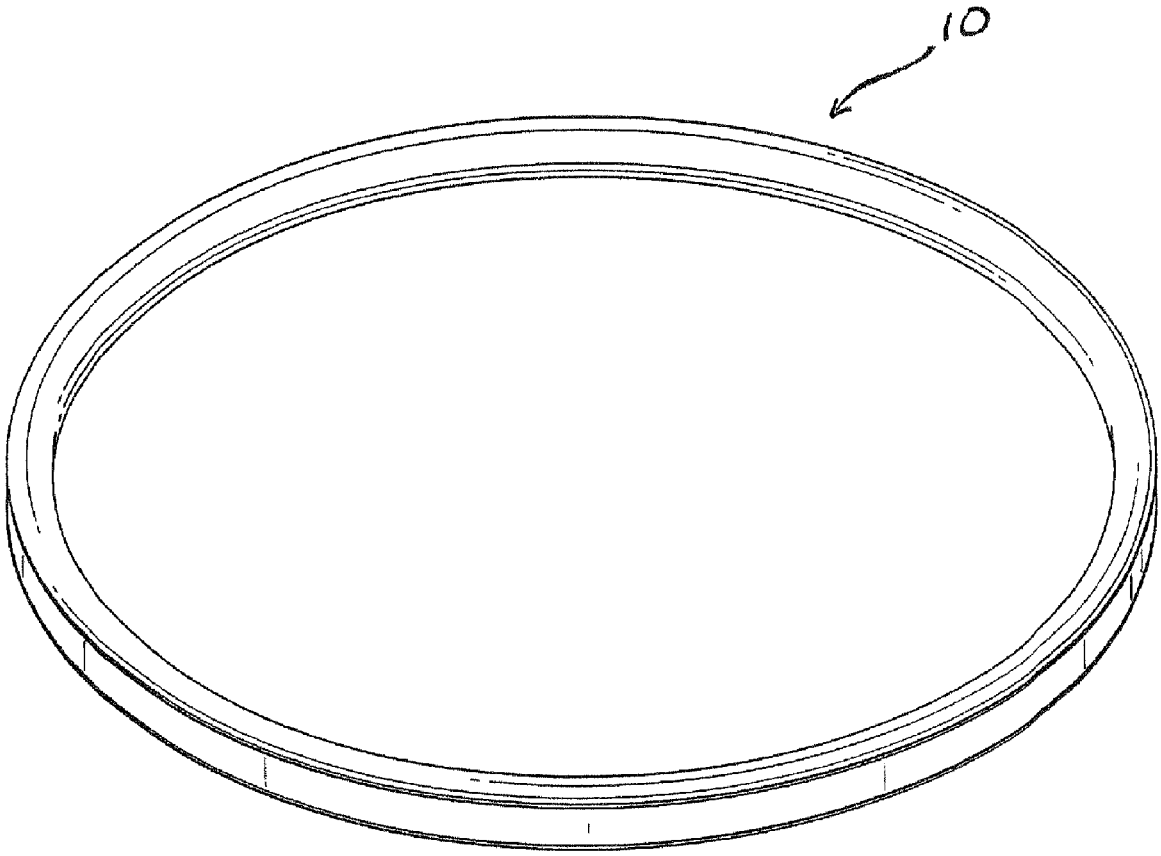
FIG. 1 shows a perspective view of a hoop in accordance with the present invention.
Figure 2:
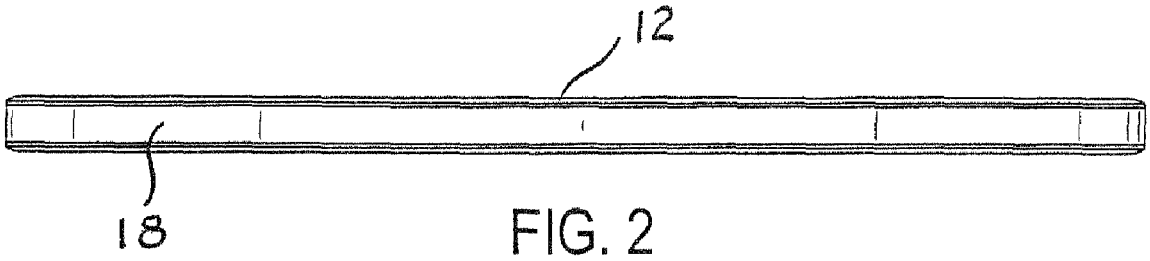
FIG. 2 shows an elevation view of the hoop of FIG. 1, the hoop being the same in elevation at 90°, 180° and 270° from the position shown in FIG. 2.
Figure 6:
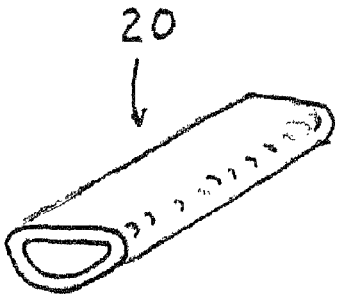
FIG. 6 is a perspective view of a connector for joining two ends of the tubing to form the hoop.
Figure 3:
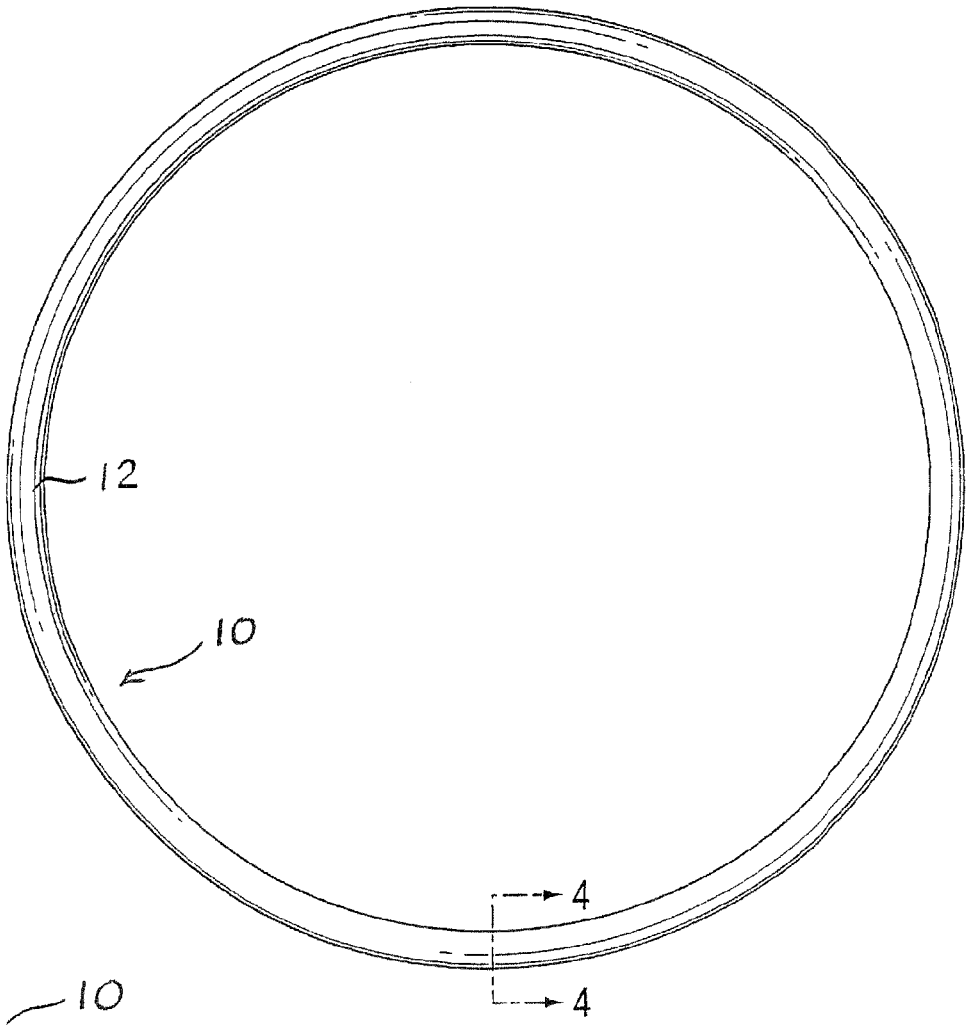
FIG. 3 shows a top view of said hoop, the bottom view being identical.
Figure 5:
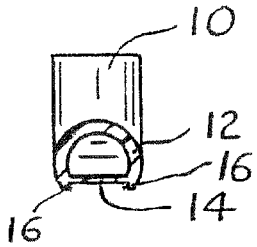
FIG. 5 shows an enlarged view similar to FIG. 4 but without the decorative strip.
Figure 4:
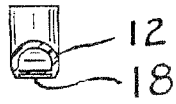
FIG. 4 is a cross-section along lines 4-4 of FIG. 3, showing the hoop with a decorative strip applied to the flat surface.

A hoop 10 is shown according to the present invention formed of a tube 12 having a generally D-shaped cross-section as best shown in FIGS. 4 and 5, with a flat wall 14 facing outwardly of the hoop 10 and located between two outwardly projecting end ribs 16. The ends of the tube 12 are joined together to form the hoop 10 by a generally D-shaped connector plug 20 as shown in FIG. 6, the outer dimensions of the connector plug 20 desirably being sufficiently close to the internal diameter of the D-shaped tube 12 so as to provide a good friction fit. Alternatively, or preferably in addition to the friction fit, staples are driven through the tube 12 and connector plug 20 therewithin from the exterior of the flat wall 14 adjacent the two ends of the tube 12.

The hoop 10 is formed of semi-rigid plastic, preferably extruded polyethylene or polyethylene terephthalate glycol (PETG), the latter being a type of saturated, i.e. thermoplastic, polyester. The connector plug 20 may be formed of a similar plastic. The wall thickness of the tube 12 can vary, but in one non-limitative example is approximately 1 mm. The overall outside dimensions can also vary, and in one non-limitative example the width of the flat portion 14 between the end ribs 16 is about 1.3 to 1.5 cm.

Placed on the flat surface 14 between the two outwardly projecting end ribs 16 is a decorative strip 18, which may simply be a decorative plastic tape having any form of decoration on its outer surface and adhesive on its inner surface. The decorative strip 18 is simply adhered to the outer surface of the flat wall 14 in any suitable manner, and may have any type of decoration thereon, e.g. diffraction rulings produced by holographic printing, or simply decorative patterns of various types.

The advantage of the present construction is that it makes decoration of the hoop 10 very simple and easy. No decorative wrapping or covering is required. An adhesive tape of any material, e.g. paper, plastic, cloth, having a decoration on its outer surface and adhesive on its inner surface, and having a width equal to or even somewhat less than distance between the end ribs 16, can simply and easily be applied to serve as the decorative strip 18, the end ribs 16 serving to provide a suitable boundary for maintaining the location of the decorative strip 18. It will be understood that with such a construction, a standard hoop can be made to which a wide variety of decorative strips can be applied.

The present construction solves another problem which undesirably sometimes arises in the prior art wherein the hoop tubing has a circular cross section, the problem of connector deformation resulting in maintaining the overall shape of the hoop. The D-shaped cross-sectional configuration of the hoop tube 12 and the connector plug 20, particularly when the corresponding connector plug 20 is well anchored within the abutted ends of the tubing 12, such as by staples, adhesive or the like, serves to maintain the shape of the hoop 10 without deformation.

It is also desirable to provide a freely flowing material within the hoop, e.g. hard beads, small ball bearings, sand, or even liquid, e.g. water. A mixture of such materials may also be provided within the tubing 12. The connector plug 20, being hollow and having a bore of substantial cross-section permits substantially unrestricted flow therethrough.

The invention has been described above as embodying a tube with a D-shaped cross-section with the end ribs 16 defining the flat portion 14 therebetween. However, it will be understood that other cross-sectional configurations are contemplated, although not preferred. One such alternative cross-sectional shape is a D-shape without the end rib 16. Other embodiments have other cross-sectional shapes including B-shaped, P-shaped, R-shaped, rectangular-shaped, and combinations thereof and variations therebetween.

The foregoing description of the specific embodiments will so fully reveal the general nature of the invention that others can, by applying current knowledge, readily modify and/or adapt for various applications such specific embodiments without undue experimentation and without departing from the generic concept, and, therefore, such adaptations and modifications should and are intended to be comprehended within the meaning and range of equivalents of the disclosed embodiments. It is to be understood that the phraseology or terminology employed herein is for the purpose of description and not of limitation. The means, materials, and steps for carrying out various disclosed functions may take a variety of alternative forms without departing from the invention.

Thus the expressions "means to . . . " and "means for . . . ", or any method step language, as may be found in the specification above and/or in the claims below, followed by a functional statement, are intended to define and cover whatever structural, physical, chemical or electrical element or structure, or whatever method step, which may now or in the future exist which carries out the recited function, whether or not precisely equivalent to the embodiment or embodiments disclosed in the specification above, i.e., other means or steps for carrying out the same functions can be used; and it is intended that such expressions be given their broadest interpretation.

What is claimed is:

1. A play and/or exercise hoop for hip gyration, comprising a plastic tube extending generally in a round circle;

said tube having a cross section with a flat outwardly facing wall, wherein said tube has a generally D-shaped cross section;

a decorative strip of plastic, cloth or paper applied exclusively to said flat outwardly facing wall;

the decorative strip being flat and flexible;

the decorative strip being adhered to the flat outwardly facing wall of the tube;

the flat decorative strip extending essentially entirely and continuously about the circumference of the hoop; and the flat decorative strip having a substantially uniform thickness.

2. The hoop of claim 1 wherein said flat flexible decorative strip has a width no greater than the width of the flat outwardly facing wall of the tube.

3. The hoop of claim 1 wherein the flexible decorative strip has a width substantially equal to the width of the flat outwardly facing wall the tube.

4. The hoop of claim 1 wherein the decorative strip comprises an adhesive layer on its inner surface.

5. A play and/or exercise hoop for hip gyration, comprising a plastic tube extending generally in a round circle;

said tube having a cross section with a flat outwardly facing wall and semi-circular wall, wherein said tube has a generally D-shaped cross section with said flat outwardly facing wall having a width equal to or approximately equal to the diameter of the plastic tube;

a decorative strip of plastic, cloth or paper applied exclusively to said flat outwardly facing wall;

the decorative strip being flat and flexible;

the decorative strip being adhered to the flat outwardly facing wall of the tube;

the flat decorative strip extending essentially entirely and continuously about the circumference of the hoop; and the flat decorative strip having a substantially uniform thickness.

6. The hoop of claim 5 wherein said flat flexible decorative strip has a width no greater than the width of the flat outwardly facing wall of the tube, whereby the decorative strip does not extend onto said semi-circular wall.

* * * * *